US008407872B2

(12) United States Patent
Powell et al.

(10) Patent No.: US 8,407,872 B2
(45) Date of Patent: Apr. 2, 2013

(54) RAIL FENCE RETRACTOR

(75) Inventors: David Powell, Galesburg, IL (US); Steven R. Watts, Galesburg, IL (US)

(73) Assignee: Tabmaster Rail Remover, Inc., Galesburg, IL (US)

( * ) Notice: Subject to any disclaimer, the term of this patent is extended or adjusted under 35 U.S.C. 154(b) by 1183 days.

(21) Appl. No.: 12/263,931

(22) Filed: Nov. 3, 2008

(65) Prior Publication Data

US 2009/0056095 A1 Mar. 5, 2009

Related U.S. Application Data

(63) Continuation of application No. 11/599,945, filed on Nov. 15, 2006, now abandoned.

(51) Int. Cl.
*B25B 27/00* (2006.01)
*B23P 19/04* (2006.01)

(52) U.S. Cl. ..... 29/239; 29/270; 29/278; 30/113; 254/131.5

(58) Field of Classification Search ..... 29/237, 29/238, 270, 278, 275, 271; 7/138, 139; 30/113, 123; 81/45, 177.1; 254/131.5; 15/235.6
See application file for complete search history.

(56) References Cited

U.S. PATENT DOCUMENTS

| | | | | | |
|---|---|---|---|---|---|
| 4,199,016 | A * | 4/1980 | Eads et al. | ..... | 30/308.3 |
| 4,287,623 | A * | 9/1981 | Tarran | ..... | 7/158 |
| 4,685,213 | A * | 8/1987 | Powers | ..... | 30/123 |
| 4,714,239 | A * | 12/1987 | LeVine | ..... | 269/3 |
| 6,029,545 | A * | 2/2000 | Harpell | ..... | 81/45 |
| 6,079,702 | A * | 6/2000 | MacDonald | ..... | 269/55 |
| 6,098,292 | A * | 8/2000 | Harpell | ..... | 30/172 |
| 6,289,540 | B1 * | 9/2001 | Emonds | ..... | 7/116 |
| 2003/0084545 | A1 * | 5/2003 | Cheng | ..... | 16/430 |
| 2003/0110643 | A1 * | 6/2003 | Wickline | ..... | 30/308.1 |
| 2009/0056095 | A1 * | 3/2009 | Powell et al. | ..... | 29/270 |

* cited by examiner

*Primary Examiner* — Lee D Wilson
(74) *Attorney, Agent, or Firm* — Hamilton IP Law, PC; Jay R. Hamilton; Charles A. Damschen

(57) ABSTRACT

A rail fence retractor allowing removal of a fence rail engaged with a fence post comprising a blade having a first and second end. The first end of the blade is configured for insertion into a fence post slot having a rail inserted therein. The rail has self-locking tabs which must be depressed for removal of the rail from the fence post slot. The fence rail retractor also has a handle which is attached to the second end of the blade. The handle allows the application of force against handle to fix the position of the handle against the fence post during removal of the rail from the fence post slot. The handle is also useful in carrying the rail fence retractor when not in use. The handles may be also be configured to allow a pair of rail fence retractors to fit or snap together when not in use.

9 Claims, 9 Drawing Sheets

RAIL FENCE RETRACTOR

CROSS REFERENCE TO RELATED APPLICATIONS

This patent application is a continuation of patent application Ser. No. 11/599,945 previously filed on Nov. 15, 2006 now abandoned, and applicant herein claims priority from and incorporates by reference in its entirety that application.

FIELD OF INVENTION

Solid or hollow rail fences having rails with self-locking tabs located at the end of the rail for insertion into and engagement with a fence posts. More particularly, a rail fence retractor allowing extraction of said fence rails from said fence posts.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

DETAILED DESCRIPTION

Listing of Elements

| ELEMENT DESCRIPTION | ELEMENT # |
|---|---|
| Fence | 1 |
| Ground | 2 |
| Fence post | 3 |
| Fence post cap | 4 |
| Rail | 5 |
| Fence post slot | 6 |
| Locking tab | 7 |
| Slot wall | 8 |
| Locking clasp | 9 |
| Retractor | 10 |

-continued

| ELEMENT DESCRIPTION | ELEMENT # |
|---|---|
| Retractor handle | 11 |
| Retractor blade | 12 |
| Blade angle | 13 |
| Retractor strap | 14 |
| Retractor string | 15 |
| Screws | 16 |
| Two-piece retractor handle | 17 |
| 90 degree angle in Blade | 18 |
| Vertical groove retractor handle | 19 |

DETAILED DESCRIPTION

Figure 1:
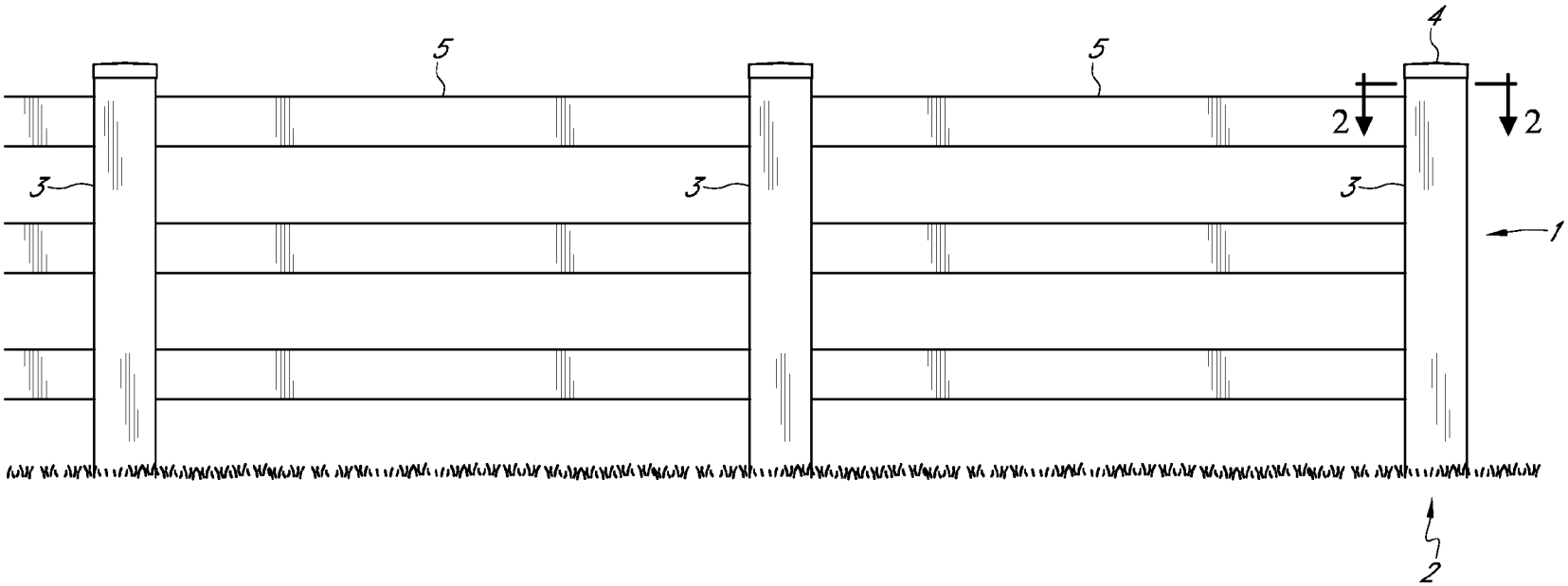
FIG. 1 is an overview of a three rail fence as found in the prior art.
Figure 2:
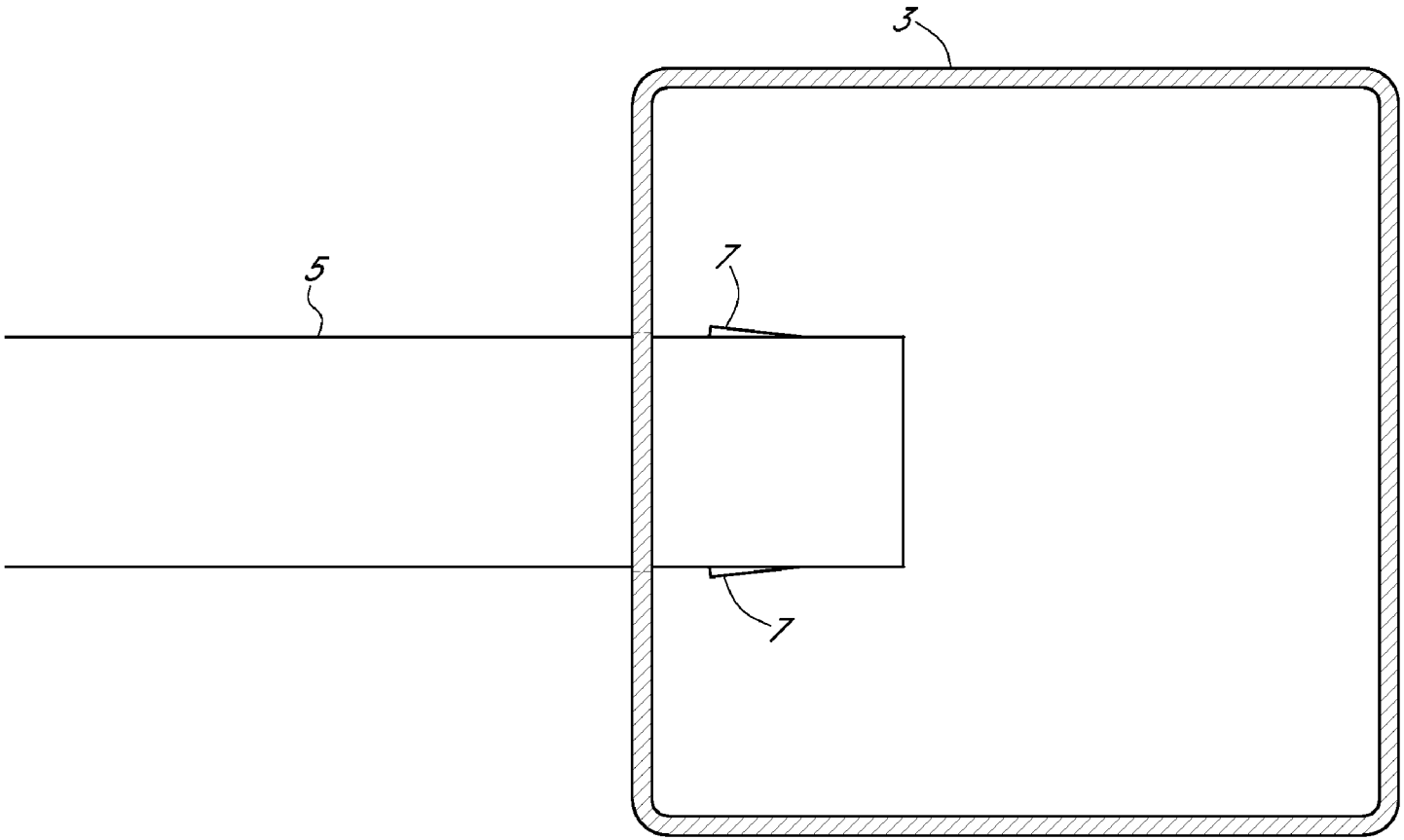
FIG. 2 is a top segment view of a rail having self-locking tabs inserted into and engaged with a fence post.
Figure 3:
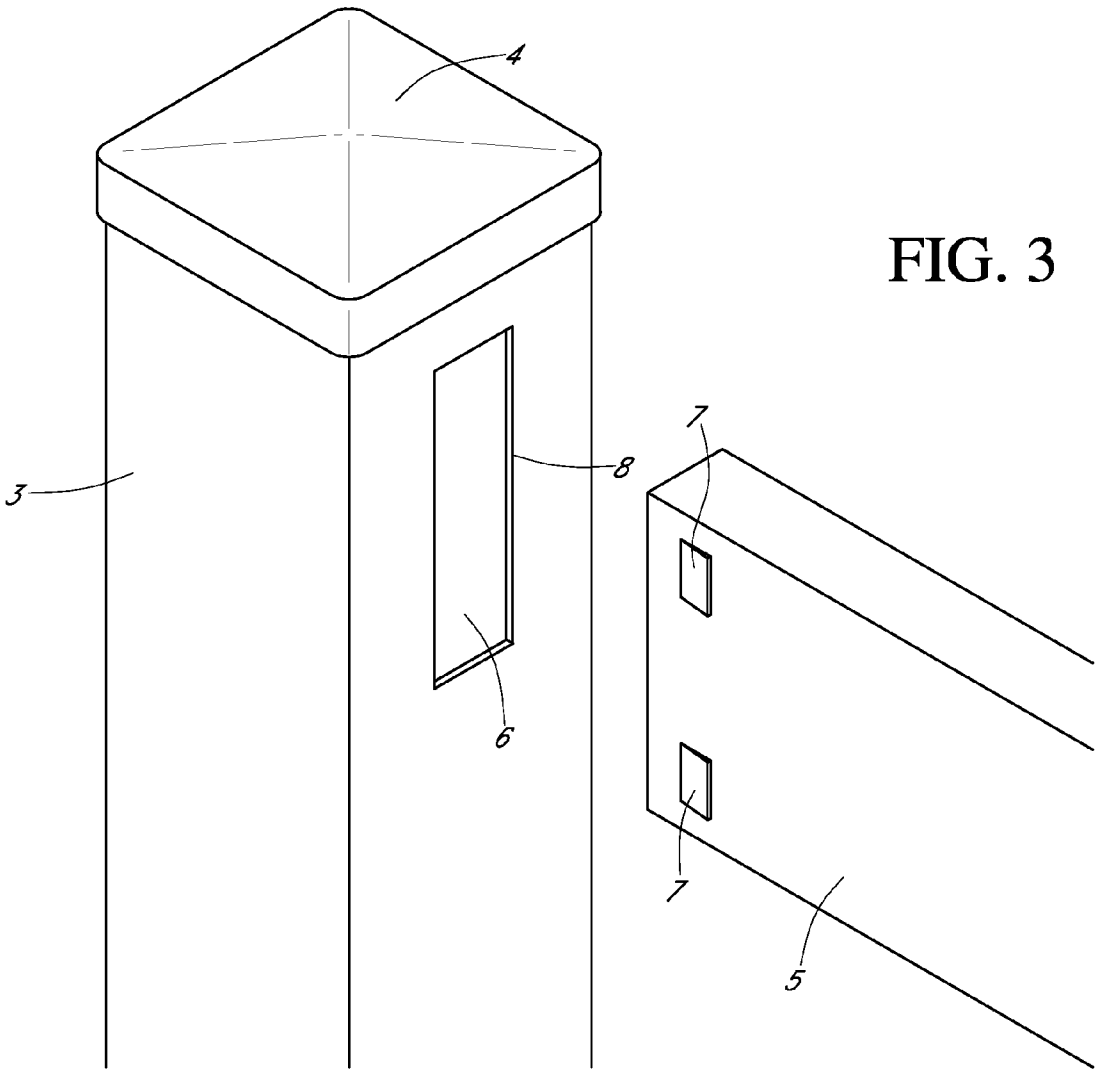
FIG. 3 illustrates a fence rail having self-locking tabs prior to insertion in the fence post as found in the prior art.

Referring now to the drawings, wherein like reference numerals designate identical or corresponding parts throughout the several views, wherein the prior art is shown in FIGS. 1, 2 and 3.

FIG. 1 provides an example of the prior art side rail fence 1 commonly available in the market place. This type of fence 1 is commonly used by ranchers and farmers for fencing livestock in or out. It is made using vinyl or vinyl derivative for improved weather resistance, decreased weight and relatively high strength. No additional hardware and a minimum of tools are necessary to install this type of fence thereby increasing its desirability for those requiring a fence. Similarly, the fence may also be produced in ascetically pleasing variations for use by home owners in applications that honor the wooden picket fences of yesterday without requiring carpentry skills for installation. U.S. Pat. No. 5,601,278 and U.S. Pat. No. 4,202,532, incorporated by reference herein, provide more background on fences of this type, as are known to those skilled in the arts.

FIG. 2 presents a top inside view of a fence post 3, with the fence post cap 4 removed, to allow inspection of the rail 5 inserted into the fence post 3. As illustrated in FIG. 2, the rail 5 is allowed a limited amount of movement within the fence post 3 but is restricted from withdrawal from the fence post 3 by the locking tabs 7 which are resilient and are said to be "self-locking."

As shown in FIG. 3, the fence 1 is assembled by sliding the rail 5 into the fence post slot 6. During insertion of the rail 5 into the fence post slot 6, the locking tabs 7 are depressed into the fence rail 5 and slide past the wall of the fence rail slot 8. After insertion, the locking tabs 7 extend out and self-lock into place, thus restricting the removal of the rail 5 from the fence post 3. This system is desirable for construction and installation as demonstrated by the large number of rail fences 1 sold in the market. To date, however, no product is known to be available to allow an installer or fence owner to retract a rail 5 from the fence post 3 without damaging or destroying the self-locking mechanism of the fence rails 5.

Figure 4:
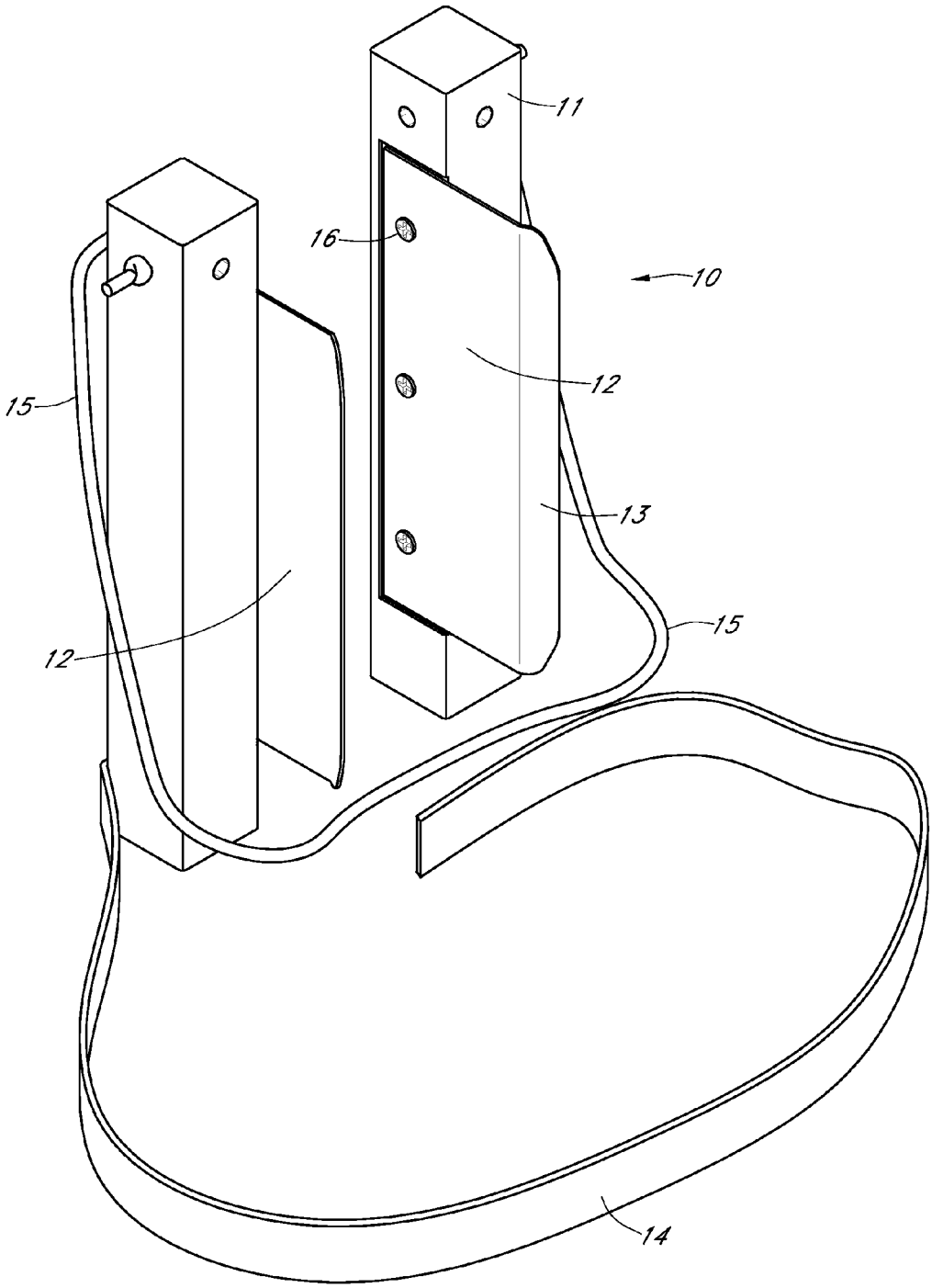
FIG. 4 presents a side view of an embodiment of the rail fence retractor disclosed herein.

FIG. 4 illustrates a fence rail retractor 10 allowing withdrawal of a rail 5 from a fence post 3 without damage to the self-locking mechanism of the rail 5. The retractor 10 is composed of a set of handles each having a retractor blade 12. The retractor blade 12 is formed of resilient material providing adequate flexibility for the retractor blade 12 to engage and slide into the fence post slot 6 having a fence rail 5 positioned therein. Plastic and thin steel are two types of materials that may be used for production of the retractor blades. The thickness of the blade may range from 0.001 inches to 0.015 inches which has been found to allow it to fit between the rail 5 and the slot wall 8 of the fence post slot 6 upon insertion into the fence post 3, in most installations. The surface of the retractor blade 12 is such that it is relatively smooth as to allow the retractor blade 12 to slide into the fence post slot 6 while positioned between the fence rail 5 and fence post slot wall 8.

The angled frontal portion of the retractor blade 13 allows the retractor blade 12 to slide between the slot wall 8 of the fence post 3 and the rail 5 for insertion into the fence post slot 6. As the retractor blade 12 slides in, the angled portion of the retractor blade 13 is more likely to meet and slide up and over the locking tabs 7 to allow full insertion of the retractor blade 12. A retractor blade 12 having a straight front portion has a tendency to meet and "bind" with or on the locking tab 7. During removal of the fence rail 5, the resilient rectractor blade 12 provides the necessary force against the self-locking tab 7 to depress the locking tab 7 and allow removal of the rail 5 from the fence post 3. The rail fence retractor as illustrated in FIG. 4-8 has an angle in the range of 33-35 degrees. Other acceptable alternative angle ranges are in the range of 1-60 degrees.

Figure 5:
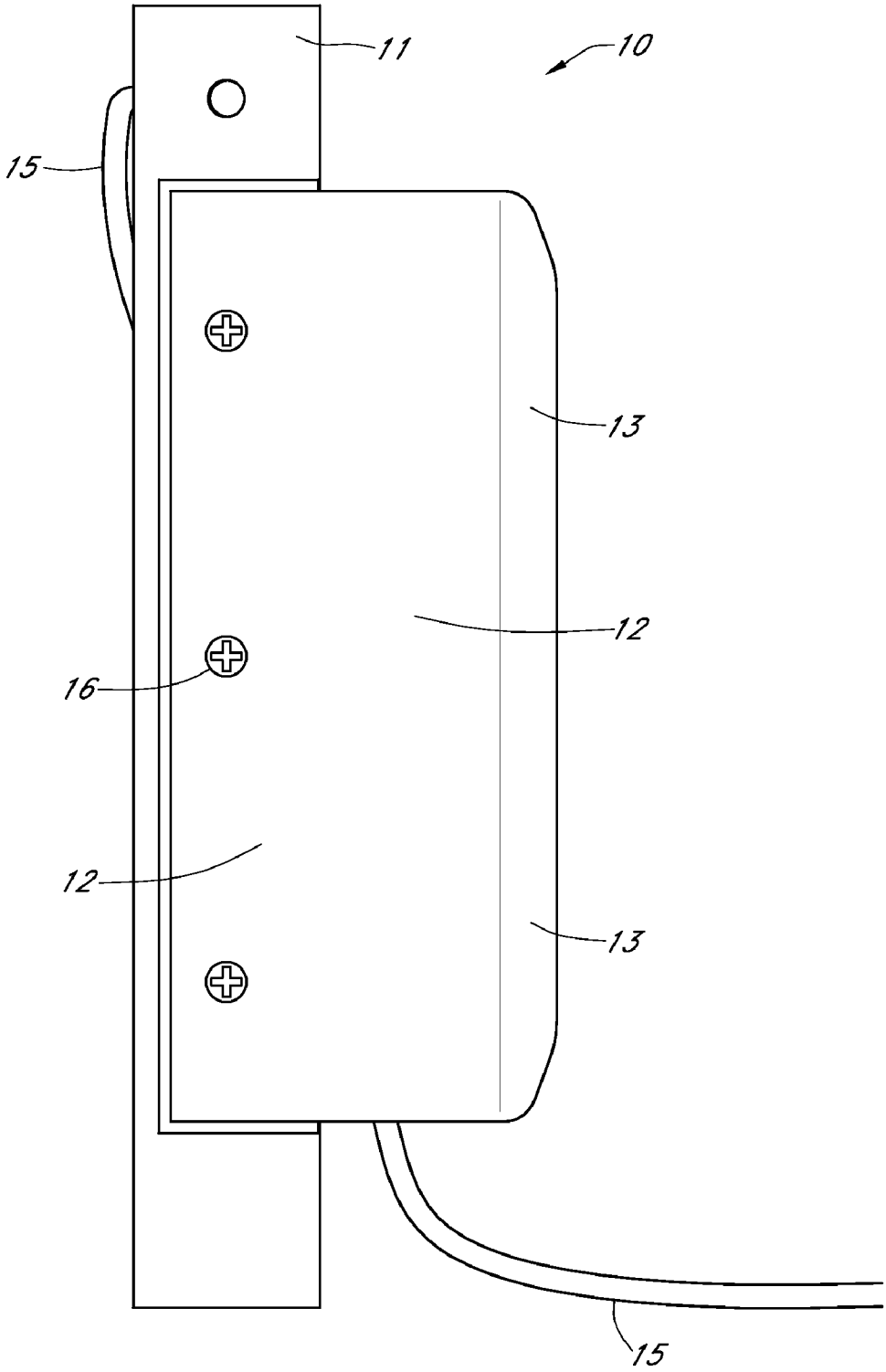
FIG. 5 illustrates the interior surface of the retractor blades.

FIG. 5 depicts an interior side view of one retractor handle 11 and retractor blade 12 to illustrate the interior surface of the retractor blade 12. As shown, the retractor blade 12 is simply mounted to the retractor handle 11 using screws 16. Other methods and means for securement of the retractor handles 11 to the retractor blades 12 are known to those skilled in the art and not described further herein. Although not shown, it is within the scope of this disclosure to include a retractor blade 12 and retractor handle 11 which are integral and produced as one-unit or element.

Figure 6:
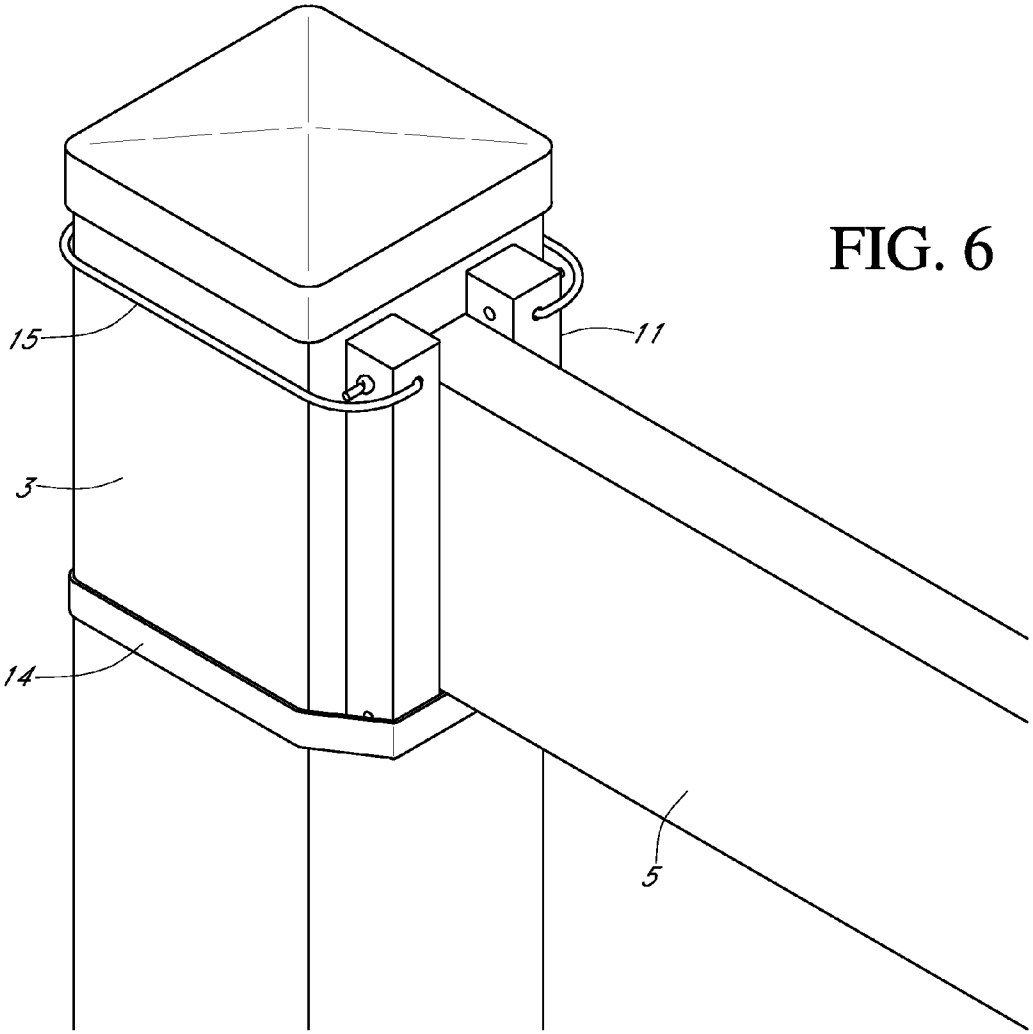
FIG. 6 illustrates the rail fence retractor positioned at the fence post prior to extraction of the fence rail.

FIG. 6 illustrates the rail fence retractor 10 positioned at the fence post 3 prior to extraction of the rail 5. The retractor strap 14, which may be used with the retractor 10, improves operation of the retractor 10 by fixing the position of the retractor relative to the fence rail 5 and fence post 3.

Fixing the position of the retractor 10 allows the user to firmly and conveniently grab the rail 5 to remove it from the fence post slot 6 by application of a lateral force. Using the retractor 10 without the straps requires the user to hold the retractor 10 in place while removing the rail 5. As shown, the retractor 10 is paired with a retractor string 15 which provides a convenient way to keep both handles and blades of the retractor 10 paired together and during rail removal, fixes the upper position of the retractor 10 to the fence post 3. In another embodiment, not shown, the string 15 may be replaced with a second retractor strap 14. The retractor strap (s) 14 may be further improved with Velcro ends allowing quick and convenient tightening and re-adjustment. Other methods and means for conveniently keeping the retractor 10 paired together and allowing fixed positioning of the retractor 10 to the fence post 3 will be apparent to those skilled in the art and are within the scope of this disclosure.

Figure 7:
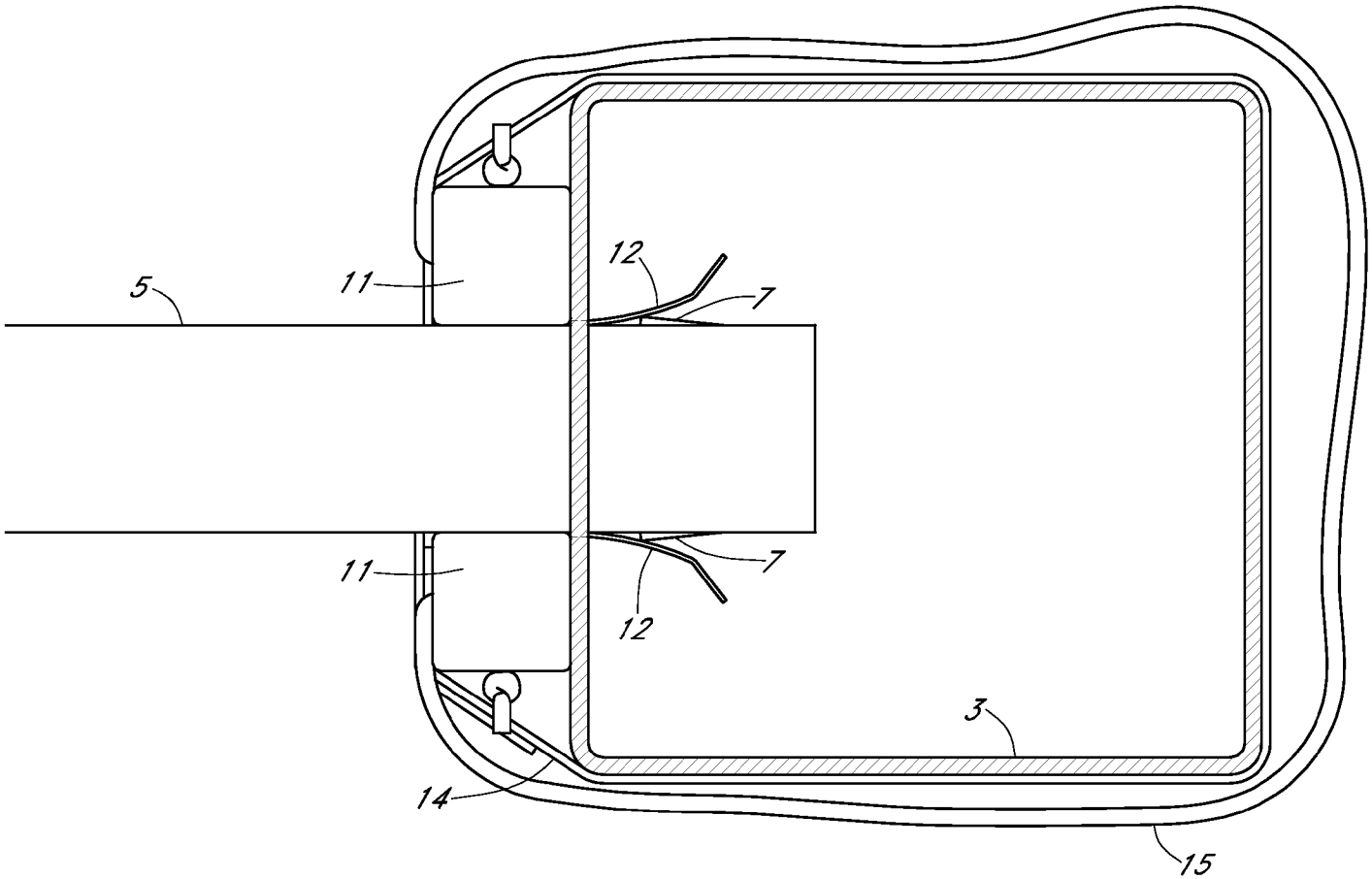
FIG. 7 is a cut-away view of the rail fence retractor positioned at the fence post prior to extraction of the fence rail.
Figure 8:
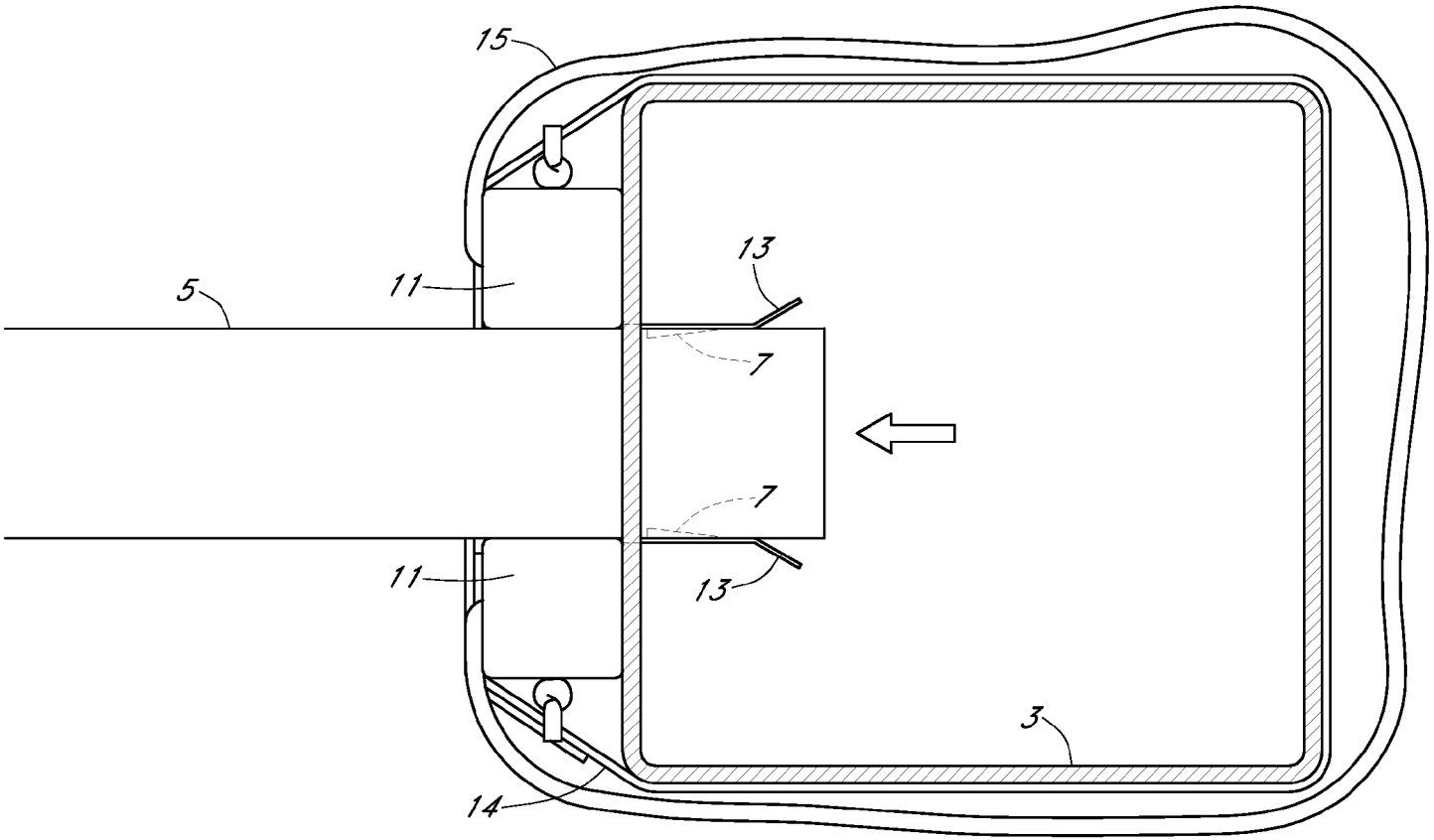
FIG. 8 illustrates the retractor blades depressing the self-locking tabs as the fence rail is removed from the fence post.

FIG. 7 is a cut-away view of the rail fence retractor 10 positioned at the fence post 3 prior to extraction of the fence rail 5. As shown, the locking tabs 7 are engaged with and positioned interior of the retractor blades 12. FIG. 8 illustrates the retractor blades 12 depressing the locking tabs 7 as the rail 5 is pulled out of the fence post slot 6 thereby bypassing or "unlocking" the self-locking function of the locking tabs 7 without destroying or damaging the locking tabs 7, the fence post 6 or the rail 5.

Figure 9:
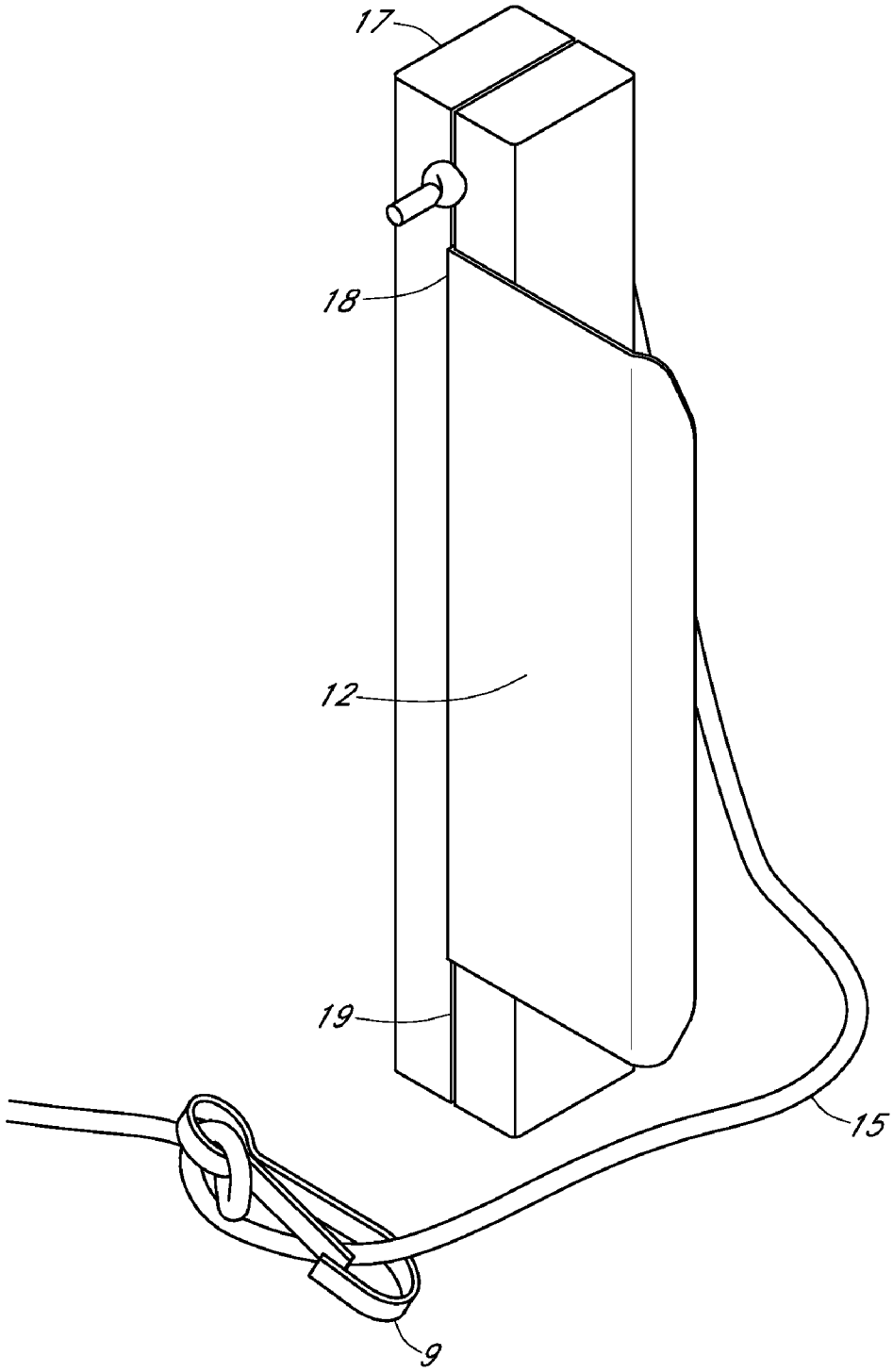
FIG. 9 illustrates another embodiment of the rail fence retractor shown at FIG. 5.

FIG. 9 depicts an interior side view of another embodiment of the retractor handle 11 and retractor blade 12 to illustrate another method of attaching the retractor blade 12 to the retractor handle 17. In this embodiment, the retractor handle 17 has been vertically divided into two separate sections. A ninety degree angle 18 has been placed in the posterior portion of the retractor blade 12 for insertion between the two separate sections of each retractor handle 17. This embodiment improves the securement of the blade within the retractor handle 17 and ensures that the interior surface of the blade 12 is not interrupted by the securement means as shown in FIG. 5. The screws 16 are then inserted into both sides of the retractor handle 11, perpendicular to the ninety degree angle 18 in the blade and parallel with the surface of the retractor blade 12 facing the rail 5. This embodiment of the invention may also be practiced by placing a vertical groove 19 in the retractor handle 11 to simulate sectioning the handle and then inserting the ninety degree angle 18 into said groove 19 prior to securement. Other securement means including bolts or glue may also be used without departing from the spirit or intent of the disclosure. FIG. 9 also illustrates a locking clasp which may be attached to the retractor string 15. The locking clasp 9 is intertwined with retractor string 15. The locking clasp 9 may be adjusted on the retractor string 15 for more or less slack; releasing the rail 5 from the fence post slot 6 sometimes requires a high level of force to be applied to the fence rail 5. This energy release is transferred to the fence rail retractor 10 upon the release creating an opportunity for the fence rail retractor 10 to bounce or rebound erratically. Adjusting the locking clasp 9 to allow little slack in the retractor string 15 reduces the bounce or rebound.

It should be noted that the present invention is not limited to the specific embodiments pictured and described herein, but is intended to apply to all fence rail retractors. Modifications and alterations from the described embodiments will occur to those skilled in the art without departure from the spirit and scope of the present invention.

The invention claimed is:

1. An apparatus allowing removal of a fence rail engaged with a fence post comprising:

a. a left rail fence retractor comprising:

i. a blade having a constant thickness along the length and width thereof, wherein said blade includes first and second portions, wherein said first and second portions are planar, wherein said blade includes first and second sides, and wherein said first portion is angled with respect to said second portion; and, ii. a handle having a rectangular cross-sectional area about its longitudinal axis, wherein said handle includes a rectangular-shaped recessed portion on a first exterior surface thereof, wherein said first side of said blade second portion abuts said recessed portion, wherein said blade is attached to said handle about said recessed portion, and wherein said second side of said blade second portion is coplanar with respect to said handle first exterior surface;

b. a right rail fence retractor comprising:

i. a blade having a constant thickness along the length and width thereof, wherein said blade includes first and second portions, wherein said first and second portions are planar, wherein said blade includes first and second sides, and wherein said first portion is angled with respect to said second portion; and, ii. a handle having a rectangular cross-sectional area about its longitudinal axis, wherein said handle includes a rectangular-shaped recessed portion on a first exterior surface thereof, wherein said first side of said blade second portion abuts said recessed portion, wherein said blade is attached to said handle about said recessed portion, wherein said second side of said blade second portion is coplanar with respect to said handle first exterior surface, and wherein said left rail fence retractor is a mirror-image of said right rail fence retractor.

2. The apparatus as set forth in claim 1 wherein said blades of said left and right rail fence retractors are defined so that the angle between said first and second portions of said blades, respectively, is in the range of 39-51 degrees.

3. The apparatus as set forth in claim 1 wherein said blades of said left and right rail fence retractors are defined so that the angle between said first and second portions of said blades, respectively, is in the range of 1-90 degrees.

4. The apparatus as set forth in claim 1 wherein a first strap is attached at a first end of said left rail fence retractor handle and allows said left rail fence retractor to be held against said fence post during removal of said fence rail from said fence post slot.

5. The apparatus as set forth in claim 4 wherein a second strap is attached at a second end of said left rail fence retractor handle and allows said left rail fence retractor to be held against said fence post during removal of said fence rail from said fence post slot.

6. The apparatus as set forth in claim 5 further comprising a retractor string secured to said handles of said left and right rail fence retractors.

7. An apparatus allowing removal of a fence rail engaged with a fence post comprising:

a. a left rail fence retractor comprising:

i. a blade having a constant thickness along the length and width thereof, wherein said blade includes first, second, and third portions, wherein said first, second, and third portions are planar, wherein said first portion is angled with respect to said second portion, and wherein said third portion is angled with respect to said second portion; and, ii. a handle having a first and second section, wherein said first and second sections have a rectangular cross-sectional area about their respective longitudinal axes, wherein said blade third portion is sandwiched between said handle first and second sections, and wherein said handle first and second sections are affixed to one another in such a manner as to secure said blade third portion there between;

b. a right rail fence retractor comprising:

i. a blade having a constant thickness along the length and width thereof, wherein said blade includes first, second, and third portions, wherein said first, second, and third portions are planar, wherein said first portion is angled with respect to said second portion, and wherein said third portion is angled with respect to said second portion; and, ii. a handle having a first and second section, wherein said first and second sections have a rectangular cross-sectional area about their respective longitudinal axes, wherein said blade third portion is sandwiched between said handle first and second sections, wherein said handle first and second sections are affixed to one another in such a manner as to secure said blade third portion there between, and wherein said left rail fence retractor is a mirror-image of said right rail fence retractor.

8. The apparatus as set forth in claim 7 wherein said angle between said blade second and said third portions is further defined as ninety degrees.

9. A method for removing a fence rail from a fence post, said method comprising the steps of:

a. positioning a retractor blade of a left rail fence retractor in a fence post slot of said fence post such that said retractor blade of said left rail fence retractor is adjacent a left slot wall of said fence post slot and a right surface of said fence rail engaged with said fence post, wherein said left rail fence refractor comprises:

i. said retractor blade having a constant thickness along the length and width thereof, wherein said retractor blade includes first and second portions, wherein said first and second portions are planar, wherein said retractor blade includes first and second sides, and wherein said first portion is angled with respect to said second portion; and, ii. a handle having a rectangular cross-sectional area about its longitudinal axis, wherein said handle includes a rectangular-shaped recessed portion on a first exterior surface thereof, wherein said first side of said retractor blade second portion abuts said recessed portion, wherein said retractor blade is attached to said handle about said recessed portion, and wherein said second side of said retractor blade second portion is coplanar with respect to said handle first exterior surface;

b. positioning a retractor blade of a right rail fence retractor in said fence post slot of said fence post such that said retractor blade of said right rail fence retractor is adjacent a right slot wall of said fence post slot and a right side of said fence rail engaged with said fence post, wherein said right rail fence retractor comprises:

i. said retractor blade having a constant thickness along the length and width thereof, wherein said retractor blade includes first and second portions, wherein said first and second portions are planar, wherein said retractor blade includes first and second sides, and wherein said first portion is angled with respect to said second portion; and, ii. a handle having a rectangular cross-sectional area about its longitudinal axis, wherein said handle includes a rectangular-shaped recessed portion on a first exterior surface thereof, wherein said first side of said blade second portion abuts said recessed portion, wherein said retractor blade is attached to said handle about said recessed portion, wherein said second side of said retractor blade second portion is coplanar with respect to said handle first exterior surface, and wherein said left rail fence retractor is a mirror-image of said right rail fence retractor;

c. manipulating said left rail fence retractor such that said retractor blade depresses a locking tab positioned on said left side of said fence rail;

d. manipulating said right rail fence retractor such that said retractor blade depresses a locking tab positioned on said right side of said fence rail;

e. securing said left and right rail fence retractors to said fence post in a position such that said rail fence retractors continuously depress said locking tabs on said left and right sides of said fence rail, respectively; and, f. moving said fence rail linearly through said fence post slot in a direction away from said fence post until said locking tabs have passed through said fence post slot.

* * * * *